US011662186B2

(12) United States Patent
Cooke

(10) Patent No.: US 11,662,186 B2
(45) Date of Patent: May 30, 2023

(54) CAPTIVE PISTON PROJECTILE AND METHOD OF MANUFACTURE

(71) Applicant: The Secretary of State for Defence, Salisbury (GB)

(72) Inventor: Samuel Brendan Dixon Cooke, Salisbury (GB)

(73) Assignee: The Secretary of State for Defence, Salisbury (GB)

( * ) Notice: Subject to any disclaimer, the term of this patent is extended or adjusted under 35 U.S.C. 154(b) by 22 days.

(21) Appl. No.: 17/309,914

(22) PCT Filed: Nov. 27, 2019

(86) PCT No.: PCT/GB2019/000163
§ 371 (c)(1),
(2) Date: Jun. 29, 2021

(87) PCT Pub. No.: WO2020/141290
PCT Pub. Date: Jul. 9, 2020

(65) Prior Publication Data

US 2022/0113121 A1 Apr. 14, 2022

(30) Foreign Application Priority Data

Jan. 4, 2019 (GB) ..... 1900086

(51) Int. Cl.
*F42B 5/18* (2006.01)
*F42B 5/10* (2006.01)
*F42B 5/184* (2006.01)

(52) U.S. Cl.
CPC ..... *F42B 5/10* (2013.01); *F42B 5/184* (2013.01)

(58) Field of Classification Search
CPC ..... F42B 5/042; F42B 5/184
See application file for complete search history.

(56) References Cited

U.S. PATENT DOCUMENTS 2,426,239 A 8/1947 Renner
2,788,744 A 4/1957 Donner
(Continued)

FOREIGN PATENT DOCUMENTS

FR 2897151 A1 8/2007
WO 8403141 A1 8/1984

OTHER PUBLICATIONS

International Patent Application No. PCT/GB2019/000163, International Preliminary Report on Patentability, dated Jul. 15, 2021, 7 pages.

(Continued)

*Primary Examiner* — Derrick R Morgan
(74) *Attorney, Agent, or Firm* — Kilpatrick Townsend & Stockton LLP

(57) ABSTRACT

A captive piston projectile (40) comprising a payload housing (43), a piston assembly attached to the payload housing (43), and actuation means (46) for urging the piston assembly from a stowed configuration to an extended configuration. The piston assembly comprises a tubular piston member (41) attached around the periphery of the payload housing (43), the attachment optionally being in the form of a circumferential groove (42) within which the piston member (41) can slide. This provides increased thrust whilst maintaining payload volume. Particularly suited to use with barrelled weapons, and also relates to a method of manufacture.

23 Claims, 12 Drawing Sheets

(56) References Cited

U.S. PATENT DOCUMENTS

| | | | | | |
|---|---|---|---|---|---|
| 3,120,186 | A * | 2/1964 | Harvey | F42B 5/045 | 102/434 |
| 3,738,271 | A | 6/1973 | La Costa | | |
| 3,842,741 | A * | 10/1974 | Brothers | F42B 12/625 | 102/490 |
| 3,967,552 | A | 7/1976 | Settles et al. | | |
| 4,226,186 | A * | 10/1980 | Peck | F42B 29/00 | 89/1.14 |
| 4,944,226 | A * | 7/1990 | Wedertz | F42B 10/18 | 102/306 |
| 5,464,172 | A * | 11/1995 | Jensen | B29C 70/207 | 102/293 |
| 7,021,219 | B1 * | 4/2006 | Dindl | F42B 5/045 | 102/470 |
| 7,484,450 | B2 * | 2/2009 | Hunn | F41F 3/04 | 124/61 |
| 8,342,097 | B1 | 1/2013 | Widder et al. | | |
| 2005/0115445 | A1 * | 6/2005 | Reynolds | F42B 5/045 | 102/469 |
| 2012/0017793 | A1 * | 1/2012 | Huffman | F42B 5/02 | 102/444 |

OTHER PUBLICATIONS

United Kingdom Patent Application No. GB1900086.8, Search Report dated Jul. 2, 2019, 3 pages.
International Patent Application No. PCT/GB2019/000163, International Search Report and Written Opinion dated Jan. 17, 2020, 13 pages.
United Kingdom Patent Application No. GB1917405.1, Combined Search and Examination Report dated May 5, 2020, 5 pages.

* cited by examiner

CAPTIVE PISTON PROJECTILE AND METHOD OF MANUFACTURE

TECHNICAL FIELD OF THE INVENTION

This invention relates to the field of captive piston projectiles.

BACKGROUND TO THE INVENTION

Conventional handheld firearms use pressurised gas to propel a projectile forwards and out of a gun barrel. This pressurised gas is generated rapidly by propellant stored in a propellant cartridge. When a firearm is used, the propellant gas escapes from the gun barrel generating a loud acoustic pressure wave and muzzle flash (a short but significant visible flash from the firearm muzzle).

As an alternative to conventional firearms, captive piston projectiles use a pyrotechnically driven piston stored within a munition, to provide thrust to a projectile. In use the piston pushes back against the breech face of the gun barrel and urges the projectile forwards. This can offer reductions in noise and visibility of a projectile launch because the pressured gases generated during launch are retainec within the piston assembly. The piston launch mechanism itself is typically stored within a cartridge of the round and is left within the gun barrel or ejected near the firer once the projectile has been launched. This leaves the heat signature of the launch and associated high pressure gases with the user of the firearm, which has negative implications for user safety.

An alternative captive piston projectile is provided in U.S. Pat. No. 8,342,097B1 wherein a projectile is proposed with integral piston member, such that the pressurised gases are carried away from a user of a firearm in the projectile, and vented gradually through vent holes in the piston assembly. In this prior art the piston is housed within the centre of the projectile, and has an elongated and narrow profile to allow for relatively large piston stroke length and maximum payload volume. However such a piston assembly is susceptible to rupture and will inevitably restrict high pressure gas flow making it inefficient at generating thrust.

Therefore it is an aim of the present invention to provide a captive piston projectile that mitigates these issues.

SUMMARY OF THE INVENTION

According to a first aspect of the invention there is provided a captive piston projectile for launching from a gun barrel, comprising a payload housing, a piston assembly attached to the payload housing, and an actuation means for urging the piston assembly from a stowed configuration to an extended configuration, such that in use the piston assembly urges against the breech of a gun barrel to thrust the projectile from the barrel, wherein the piston assembly comprises a tubular piston member attached around the periphery of the payload housing. The captive piston projectile is suitable for use with barrelled weapons.

By providing a tubular piston member that is attached around the periphery of the payload housing, the diameter of the tubular piston member approximates that of the payload housing. Therefore the surface area against which pressurised gases within the piston assembly can act is substantially larger than that provided by prior art captive piston projectiles that are reliant on thinner pistons held within the payload housing. This both increases thrust and allows for greater payload volume. The piston assembly is designed to travel with the payload housing and therefore is permanently attached to the payload housing. The stowed configuration is the prelaunch configuration of the projectile where the piston member has not been deployed. The extended configuration is the launched configuration of the projectile where the piston member and payload housing have been urged apart.

In some embodiments the tubular piston member is collapsible such that in the stowed configuration it is collapsed against the payload housing. This allows the captive piston projectile to be relatively compact prior to launch. In preferred embodiments the tubular piston member comprises a bellows portion to allow for collapsibility. Bellows can be formed from a number of lightweight flexible materials such as lightweight plastics which are easy to manufacture. The bellows portion is inflated by pressurised gases within the piston assembly to cause the piston member to move towards the extended position.

Bellows provide a lightweight option for collapsible piston members. Even more preferred embodiments comprise a bellows portion that when the piston member is in the stowed configuration, are folded perpendicular to the axis of the captive piston projectile. This is less complex than parallel folded bellows and allows for larger piston member stroke lengths, thereby achieving greater thrust. The axis of the captive piston projectile is considered to be the concentric axis of the projectile.

In alternative embodiments comprising a collapsible tubular piston member, the piston member comprises a plurality of telescoping sections. This allows a relatively long stroke length for the piston member, whilst also remaining compact in the stowed configuration. Preferably three telescopic sections are used.

In other embodiments the tubular piston member is arranged to slide with the payload housing, such that in the stowed configuration the payload housing is at least partially received into the tubular piston member. The tubular piston member is hollow and therefore may sit around the outside of the payload housing and be arranged to slide therewith. This maximises payload volume because the payload housing is received entirely into the piston member in the stowed configuration. The tubular piston member may comprise protrusions from its inner surface that slide in lateral grooves extending partially along the length of the exterior surface of the payload housing. The grooves may terminate at abutments so as to prevent the piston member from separating from the payload housing (keeping the piston member captive with the housing).

Alternatively and preferred is that the payload housing comprises a circumferential groove into which the tubular piston member is arranged to slide. The circumferential groove will be as long as the piston stroke length. In this configuration part of the payload housing is still received into the tubular piston member when in the stowed configuration, but the exterior profile of the payload housing is uniform and more aerodynamic. It is preferable that the circumferential groove comprises an end stop and the tubular piston member comprises a protrusion that abuts the end stop when in the extended configuration, such that the tubular piston member is retained within the circumferential groove. These embodiments also offer the benefit of being less complex to manufacture.

In some embodiments the tubular piston member is internally tapered. The internal bore of the tubular piston member may be widest at the end proximal the payload housing, and decrease along the piston member therefrom. The payload housing may be formed to be conformal to the tapering. This minimises resistance to piston member movement, maximises the area that pressurised gas initially acts upon and allows pressurised gas to flow more freely in the piston assembly.

Particular embodiments further comprise stabilisation fins retractably attached to the tubular piston member. Stabilisation fins give the captive piston projectile stability during flight, and can be stowed within the tubular piston member when the piston assembly is in the stowed configuration. For instance the stabilisation fins may conform to the exterior surface of the tubular piston member in the stowed configuration, but more preferably are recessed into respective longitudinal slots in the piston member. The stabilisation fins may be attached to the piston member using a hinge or pivot at one end, about which they can rotate outwards from the piston member. It is even more preferable that the stabilisation fins are biased outwards of the piston member by spring or other biasing means. This ensures that the stabilisation fins are automatically deployed when the tubular piston member is urged away from the payload housing, and the piston assembly is in the extended configuration. Stabilisation fins that are biased outwards may also be used in some preferred embodiments as detents, to hold the captive piston projectile in position inside a gun barrel prior to launch, thereby eliminating the need for an additional projectile casing. In these embodiments the restriction to movement enforced by the detents can be overcome by the thrust generated during launch of the captive piston projectile.

Some embodiments further comprise a vent means for venting gases compressed by action of the tubular piston member sliding with the payload housing. The sliding interface between the tubular piston member and payload housing may define a void filled by gas (for instance air trapped during manufacture). As the piston member and payload housing slide against each other in use, this gas may become compressed and work against the overall propulsion of the projectile. Whilst in some embodiments the actuation means may generate sufficient thrust to mitigate this issue, providing a vent means allows for a more efficient sliding of the piston member and payload housing, by venting the gases as they compress.

In even more preferred embodiments the vent means comprises vent grooves defined between the tubular piston member and the payload housing. The vent grooves may be formed in the piston member or the payload housing, to provide a conduit through which gases compressed by sliding of the piston member and housing can escape. The vent grooves may be arranged to allow venting throughout the piston stroke (from stowed to extended). However it is preferable that the vent grooves only extend partway along the length of either the piston member or payload housing, such that towards the end of the piston stroke (the extended configuration) the compressed gases cannot escape, and thereby provide a cushioning effect. This mitigates damage and noise generated by the tubular piston member and payload housing impacting each other in the extended configuration.

In preferred embodiments the actuation means comprises a propellant cartridge in fluid connection with the tubular piston member, such that in use propellant gases can flow into the tubular piston member to urge the piston assembly into the extended configuration. The propellant cartridge provides a plug fit into the tubular piston member such that propellant gases can only flow into the inner cavity defined by the tubular piston member. Whilst high pressure gas cylinders or even springs could be used to urge the piston member from the payload housing, use of a propellant cartridge allows initiation of the captive piston projectile using a standard gun firing pin mechanism. The propellant cartridge may be formed from brass.

Some embodiments may comprise vent holes provided along part of the length of the tubular piston member such that as the member approaches the end of its stroke, the vent holes enter into fluid connection with atmosphere, thereby allowing high pressure propellant gases to escape the piston assembly, and thereby reducing the thrust driving the piston member in the final stages of the piston stroke.

In some embodiments the high pressure gases generated by the propellant cartridge may also be vented out of the captive piston projectile and applied usefully as thrust vectoring. However, in preferred embodiments the tubular piston member is sealed to the payload housing such that propellant gases are sealed within the captive piston projectile. This minimises visible and audible effects of projectile launch.

According to a second aspect of the invention there is provided an ammunition round comprising a projectile casing and the captive piston projectile of the first aspect of the invention. The casing provides environmental protection to the projectile prior to launch and a means of holding the round within its weapon prior to launch, and detaches from the projectile during launch such that the casing remains within a gun barrel from which the projectile has been launched.

According to a third aspect of the invention there is provided a method of manufacturing a captive piston projectile, comprising the steps of providing a payload housing; attaching a tubular piston member around the periphery of the payload housing, the tubular piston member being adjustable between a stowed configuration and an extended configuration; and arranging an actuation means to urge the tubular piston member from the stowed configuration to the extended configuration when the captive piston projectile is in-use. This method of manufacture can be used to produce captive piston projectiles with piston assemblies having a relatively large surface area for the generation of thrust, in comparison to other captive piston projectiles.

Preferably the step of attaching a tubular piston member comprises the step of configuring the tubular piston member to slide with the payload housing between the stowed configuration and the extended configuration. This allows for a relatively long stroke length between the stowed configuration and the extended configuration, maximising projectile thrust.

Even more preferable is for the step of configuring the tubular piston member to slide to comprise the step of locating the tubular piston member inside a circumferential groove of the payload housing. This allows the payload space in the payload housing to be minimally compromised by the attachment of the tubular piston member.

BRIEF DESCRIPTION OF THE DRAWINGS

Embodiments of the invention will now be described by way of example only and with reference to the accompanying drawings, in which.

DETAILED DESCRIPTION

Figure 1:
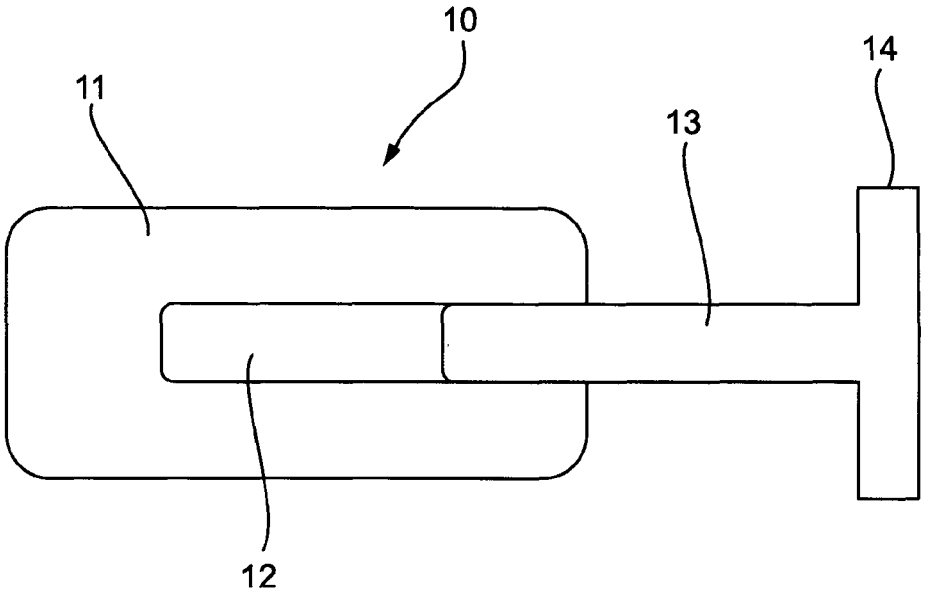
Fig. 1 Prior art
FIG. 1 illustrates in cross sectional view a prior art captive piston projectile.

FIG. 1 illustrates in cross sectional view a prior art captive piston projectile 10. The projectile 10 comprises a payload housing 11 having a concentric bore 12 into which a solid piston member 13 is received. The piston member 13 can slide within the bore 12 between a stowed position in which the base end 14 of piston member 13 abuts housing 11, and an extended configuration in which the piston member 13 protrudes from the bore 12. Propellant gases generated by the projectile 10 flow into bore 12 and urge the piston member 13 towards the extended configuration. The bore 12 is narrow and restricts gas flow making projectile 10 inefficient at generating thrust. Piston member 13 is also narrow and prone to rupture.

Figure 2A:
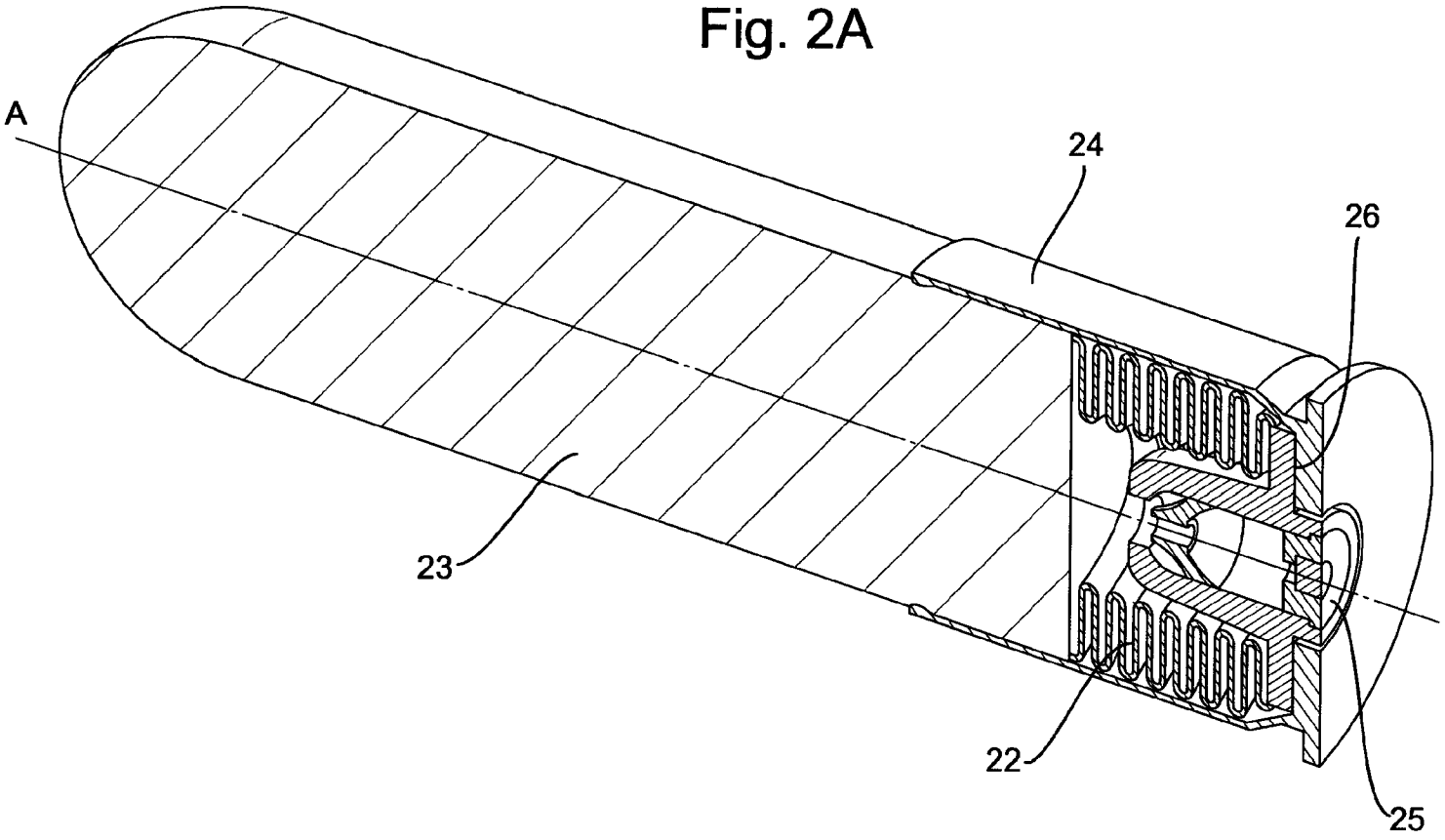
FIG. 2A illustrates in perspective cutaway view an embodiment of a captive piston projectile comprising bellows in the stowed configuration.
Figure 2B:
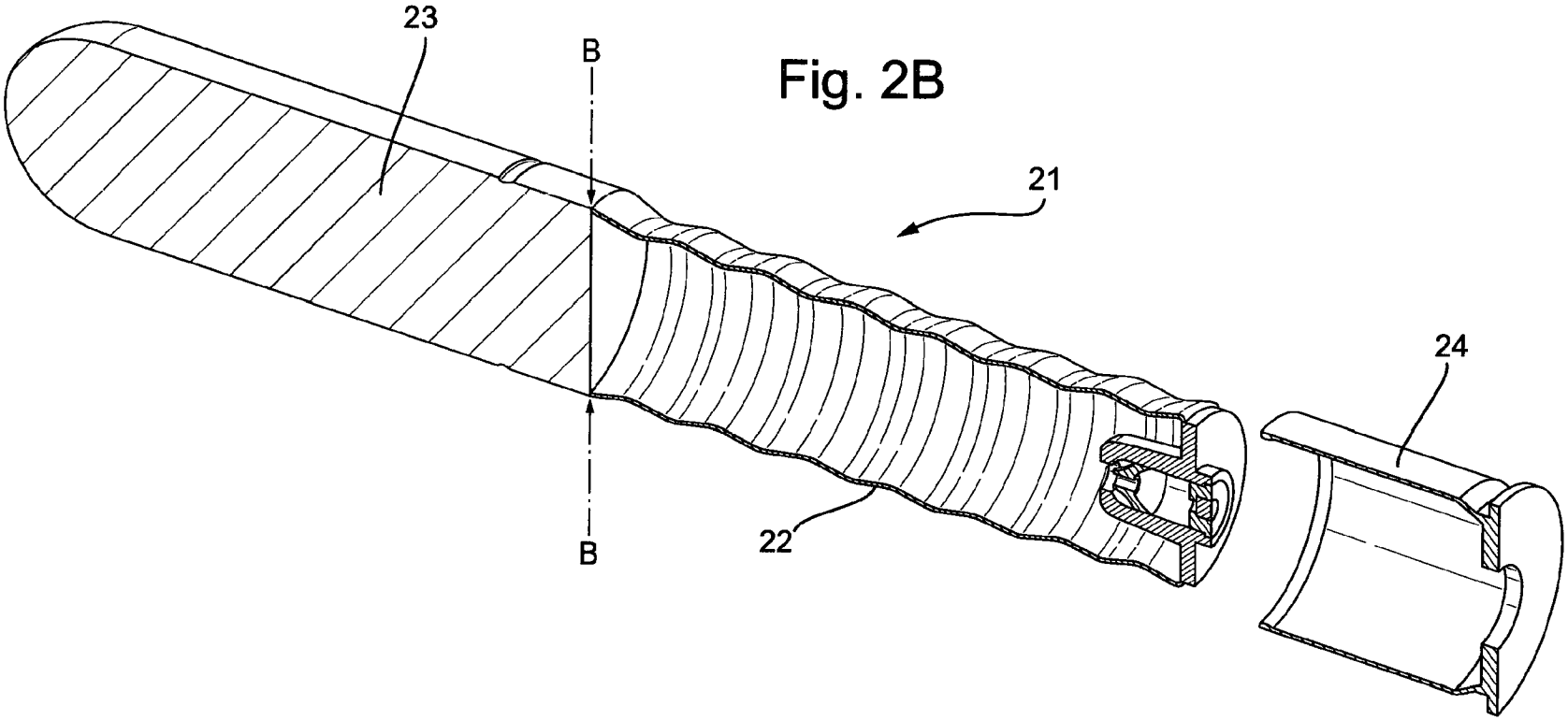
FIG. 2B illustrates in perspective cutaway view the embodiment of FIG. 2A in the extended configuration.

FIGS. 2A and 2B illustrate an embodiment of a captive piston projectile 21 and a detachable casing 24. The projectile 21 has a tubular piston member comprising bellows 22. FIG. 2A shows the projectile 21 in the compressed configuration with bellows 22 folded against payload housing 23. The bellows 22 are permanently attached to housing 23 using welding or appropriate adhesive such that a fluid seal is achieved. A casing 24 is shown surrounding the bellows 22 supplying prelaunch protection and a means of holding the round within its weapon before launch. The casing 24 extends around part of the payload housing 23 and is crimped thereto. Mounted within the bellows 22 but accessible through the casing 24 is a propellant cartridge 25. The propellant cartridge 25 is in fluid connection with the interior of the bellows 22 such that propellant gases can flow into the bellows 22. The bellows 22 are folded perpendicular to the axis 'A' of the captive piston projectile 21 for compact storage and efficient piston stroke. The bellows 22 are formed from deformable metal with the payload housing 23 also being formed from metal. In use propellant gases from propellant cartridge 25 flow into the bellows 22 and cause an increase in pressure. This causes the bellows 22 to unfold increasing their length. The base end 26 of the bellows 22 urges against casing 24, itself urging against the breech of a gun barrel (not shown). The projectile 21 is therefore thrust from the casing 24 and out of the barrel. The casing 24 is left within the gun barrel and does not form part of the projectile itself. FIG. 2B illustrates the projectile 21 in the extended configuration where bellows 22 have unfolded to provide an overall piston stroke length of 91 mm. The diameter B of the cross section against which pressurised gases inside the bellows 22 can act is significantly larger (relative to projectile size) than the prior art shown in FIG. 1. This has been achieved without compromise to payload space in payload housing 23.

Figure 3A:
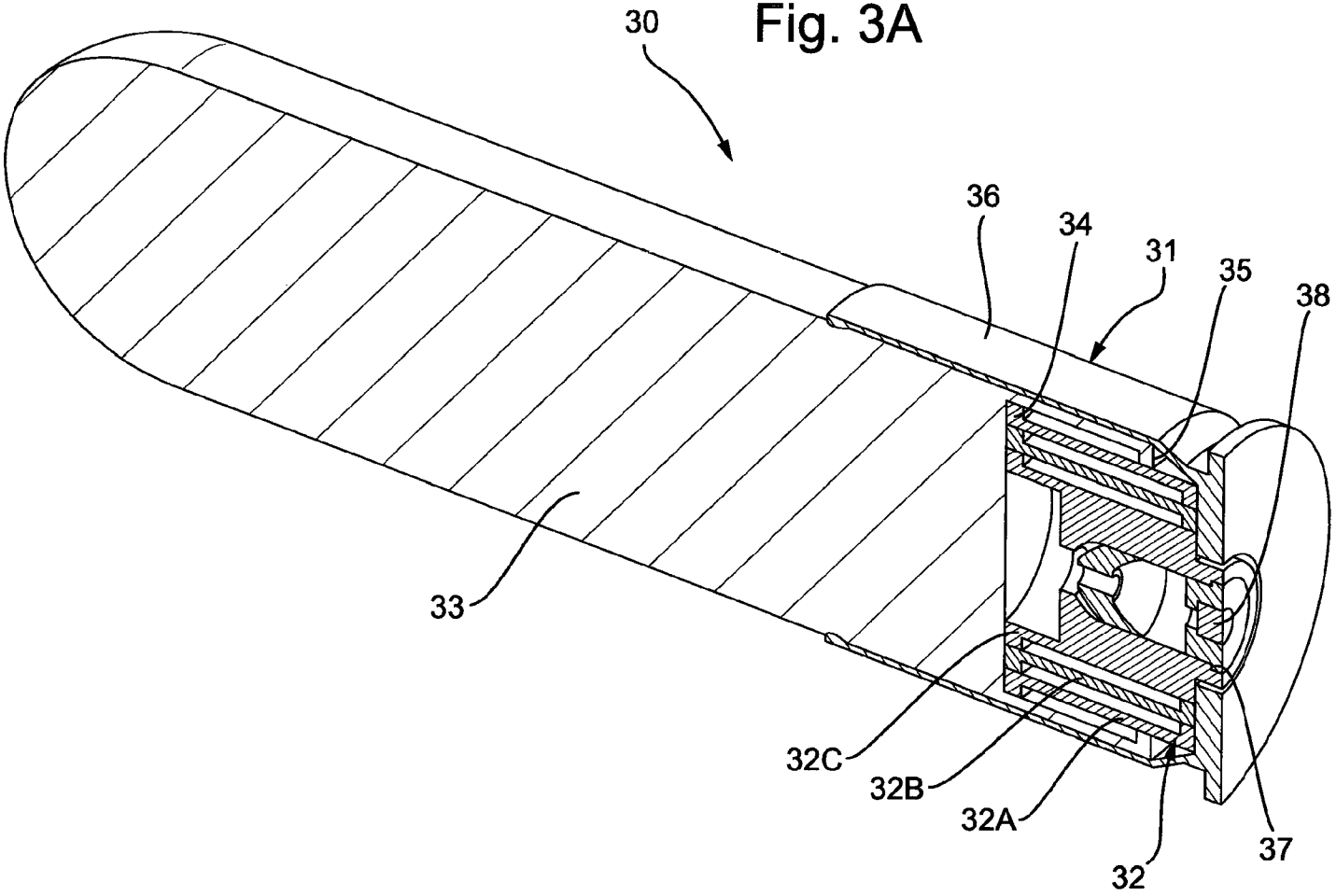
FIG. 3A illustrates in perspective cutaway view an embodiment of a captive piston projectile comprising telescoping sections in the stowed configuration.
Figure 3B:
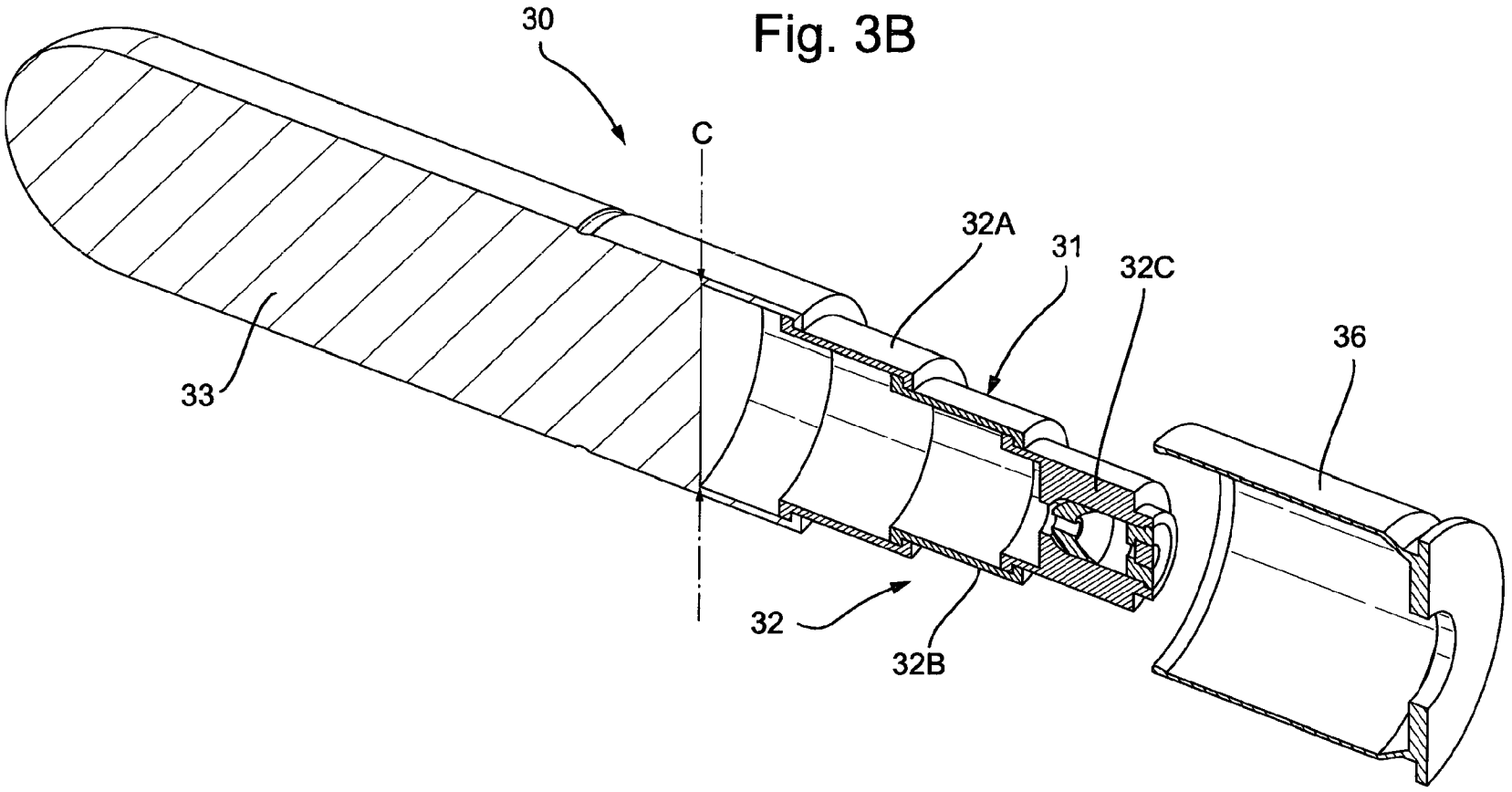
FIG. 3B illustrates in perspective cutaway view the embodiment of FIG. 3A in the extended configuration.

FIG. 3A and FIG. 3B illustrate an alternative embodiment of a captive piston projectile 30 and a detachable casing 36. The projectile 30 has a tubular piston member 31 comprising telescoping sections 32. FIG. 3A shows the projectile 30 in the compressed configuration with three telescoping sections 32A, 32B and 32C, stowed within each other. This provides compact storage against payload housing 33. The telescoping sections 32 are stored within payload housing 33. The outermost telescoping section 32A conforms to the interior surface of payload housing 33 and can slide within the housing 33 until an annular protrusion 34 abuts a narrowing ring end stop 35 of housing 33. Similar arrangements are provided for telescoping sections 32B sliding within outer section 32A, and section 32C sliding within section 32B. A casing 36 surrounds the piston member 31 and extends over part of payload housing 33 where it is held by interference fit. Providing a plug fit into the base end 37 of piston member 31 is a propellant cartridge 38. The propellant cartridge 38 is in fluid connection with the interior of the piston member 31 such that propellant gases can flow into the space between the piston member 31 and payload housing 33. In use the propellant cartridge 38 is initiated by a firing pin mechanism and propellant gases flow into the piston member 31. This causes a pressure increase and the telescoping sections 32 are urged to slide away from the payload housing 33. This causes the piston member 31 to extend and urge against a breech face of a gun barrel, such that the projectile 30 can be thrust out of the casing 36 and out of the barrel. FIG. 3B illustrates the projectile 30 of FIG. 3A in the extended configuration. The telescoping sections 32 are fully extended giving a piston stroke length of 91 mm. The casing 36 has been urged off the piston member 31. The cross sectional area against which propellant gases can act inside piston member 31 is significantly increased over the prior art and indicated by diameter C in the figure. The payload housing 33 and telescoping sections 32 are formed from metal.

Figure 4A:
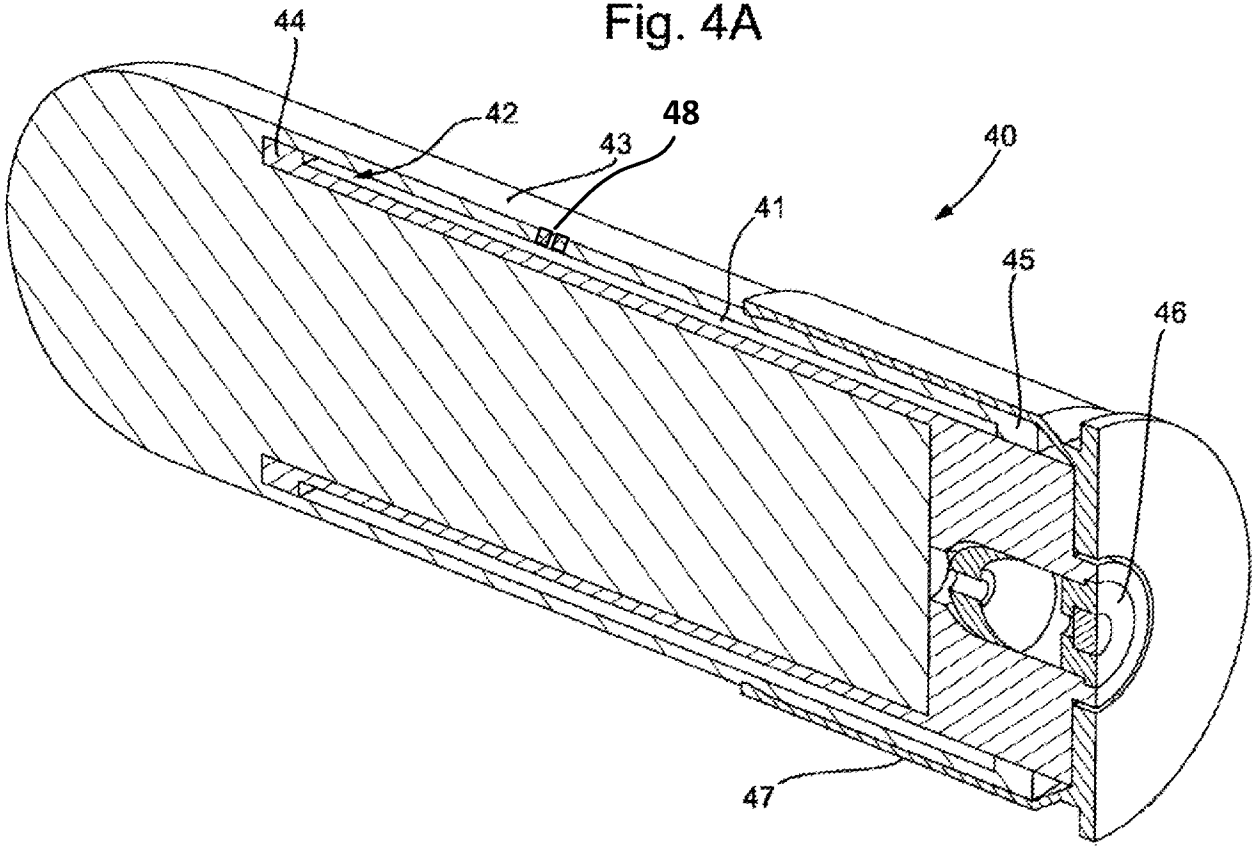
FIG. 4A illustrates in perspective cutaway view an embodiment of a captive piston projectile having a circumferential groove and a tubular piston member in the stowed configuration.
Figure 4B:
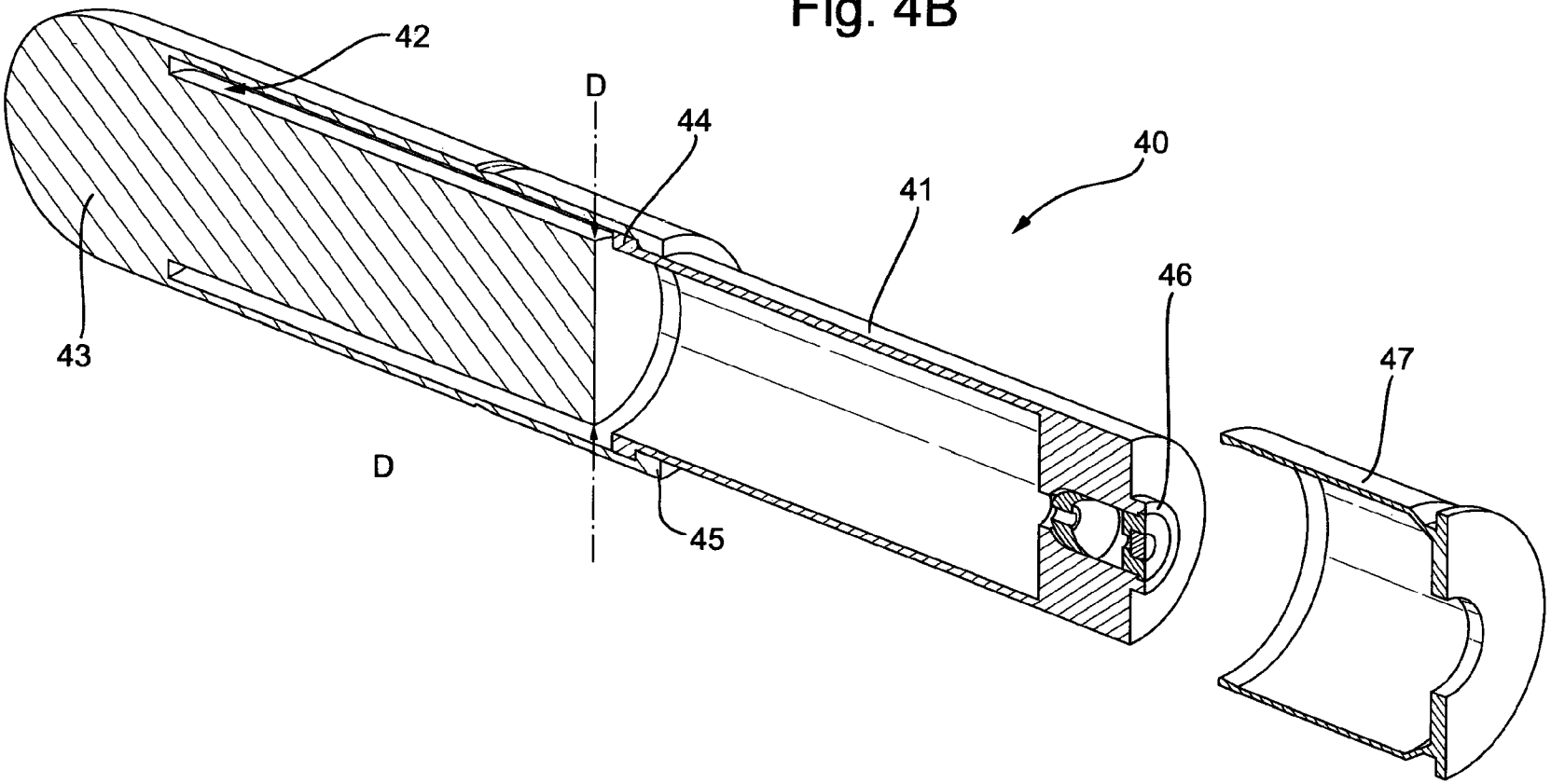
FIG. 4B illustrates in perspective cutaway view the embodiment in FIG. 4A in the extended configuration.

FIG. 4A and FIG. 4B illustrate a further alternative embodiment of a captive piston projectile 40 and detachable casing 47. The captive piston projectile 40 comprises a payload housing 43 having a circumferential groove 42 into which a hollow tubular piston member 41 is received. The tubular piston member 41 can slide within the circumferential groove 42 until a circumferential protrusion 44 on piston member 41 abuts an annular end stop 45 on payload housing 43. The circumferential groove 42 in the payload housing 43 spans a length equivalent to that of the tubular piston member 41. This ensures in the stowed configuration (shown in FIG. 4A) for the projectile 40 is compact, but maximises piston stroke length in the extended configuration (shown in FIG. 4B). A propellant cartridge 46 is shown providing a plug fit into the end of piston member 41 and is in fluid connection with the interior of the piston member 41. A projectile casing 47 is also shown. In use propellant gases from the propellant cartridge 46 enter into the piston member 41 which causes a pressure increase. The piston member 41 is urged away from payload housing 43 and resultantly slides along groove 42. The piston member 41 urges against the breech face of a gun barrel (not shown), thrusting the projectile 40 out of the barrel. The embodiment shown is formed from metal, has a maximum piston stroke length of 90 mm, and has a maximum exterior diameter of 40 mm. The payload housing 43 is minimally compromised to provide for the piston member 41. FIG. 4B shows the captive piston projectile 40 in the extended configuration, and highlights. the large cross sectional area D against which pressurised gases can act. FIG. 4A further depicts vent grooves 48, located between the tubular piston member 41 and the payload housing 43.

Figure 5A:
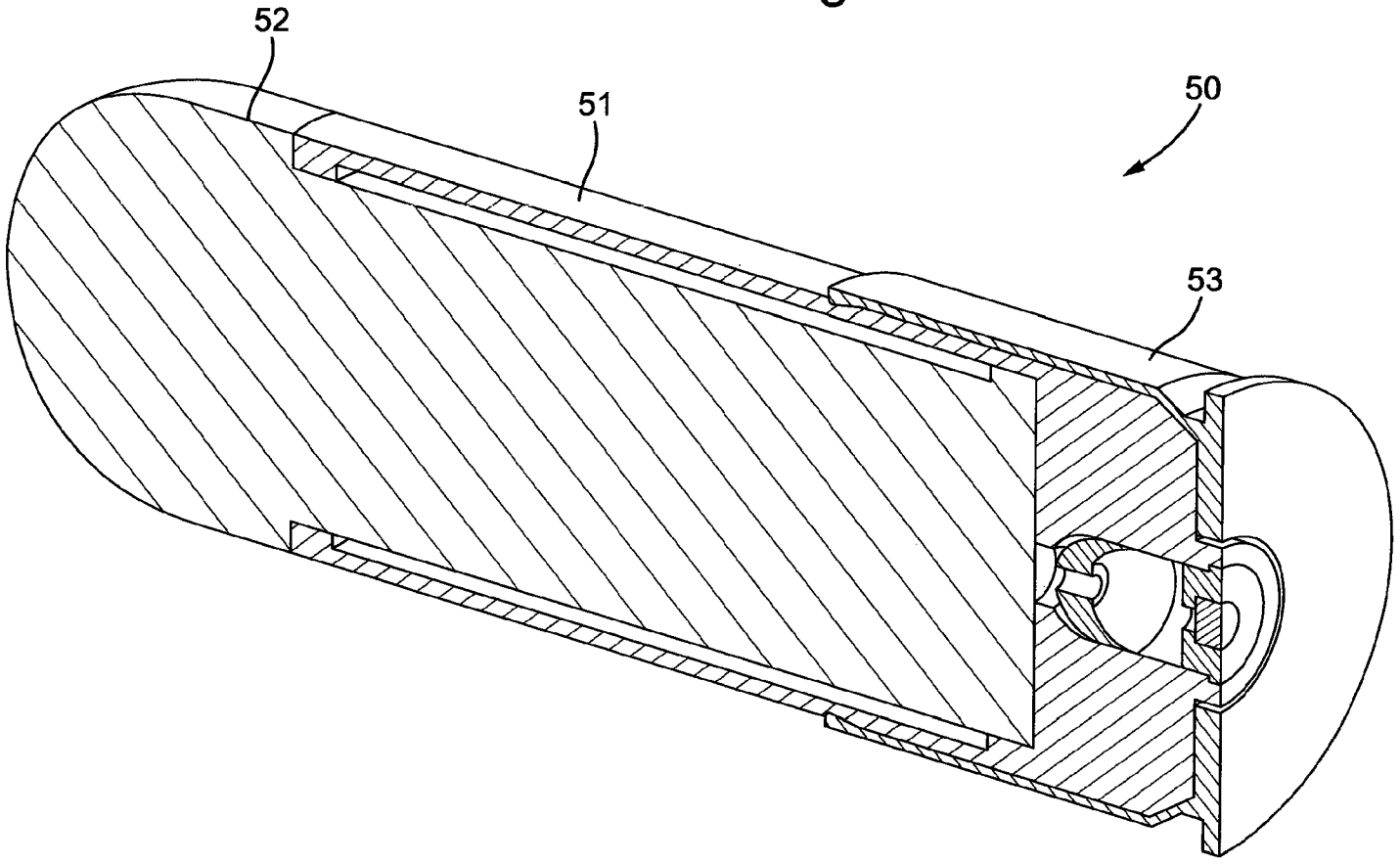
FIG. 5A illustrates in perspective cutaway view an embodiment of a captive piston projectile having a tubular piston member in the stowed configuration received around the payload housing.
Figure 5B:
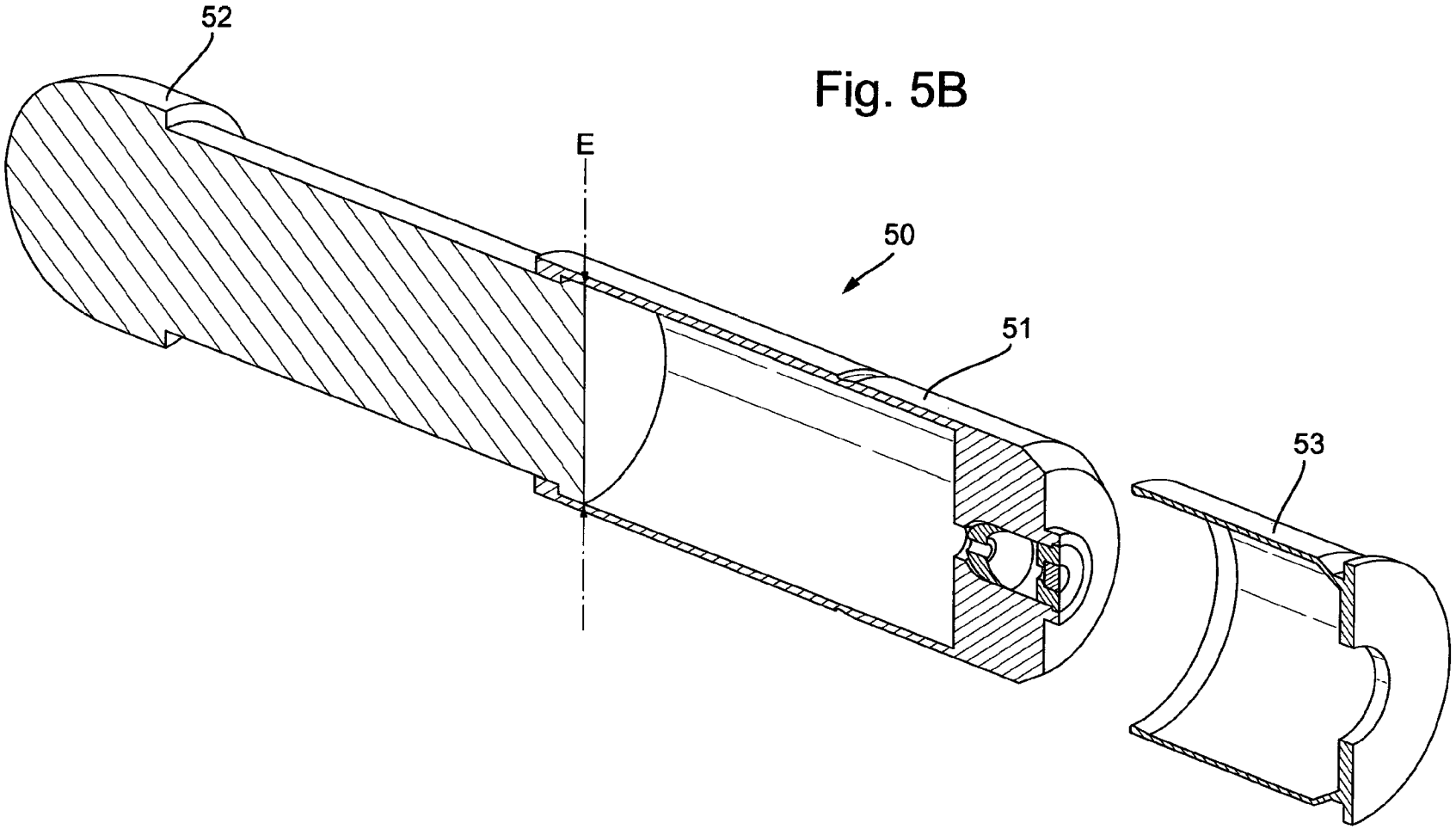
FIG. 5B illustrates in perspective cutaway view the embodiment in FIG. 5A in the extended configuration.

FIG. 5A and FIG. 5B show an alternative embodiment of a captive piston projectile 50 and detachable casing 53, with projectile 50 respectively in the stowed and extended configurations. The projectile 50 in these embodiments comprises a tubular piston member 51 mounted around a payload housing 52 on which it can slide. The payload housing 52 is narrowed to accommodate the piston member 51 whilst maintaining a uniform exterior diameter when in the stowed configuration. The mechanism for urging apart the piston member 51 from the payload housing 52 is the same as for the previous embodiments. FIG. 5B highlights clearly the maximised cross sectional area (courtesy of diameter E) against which pressurised gases inside the tubular piston member 51 can act.

Figure 6A:
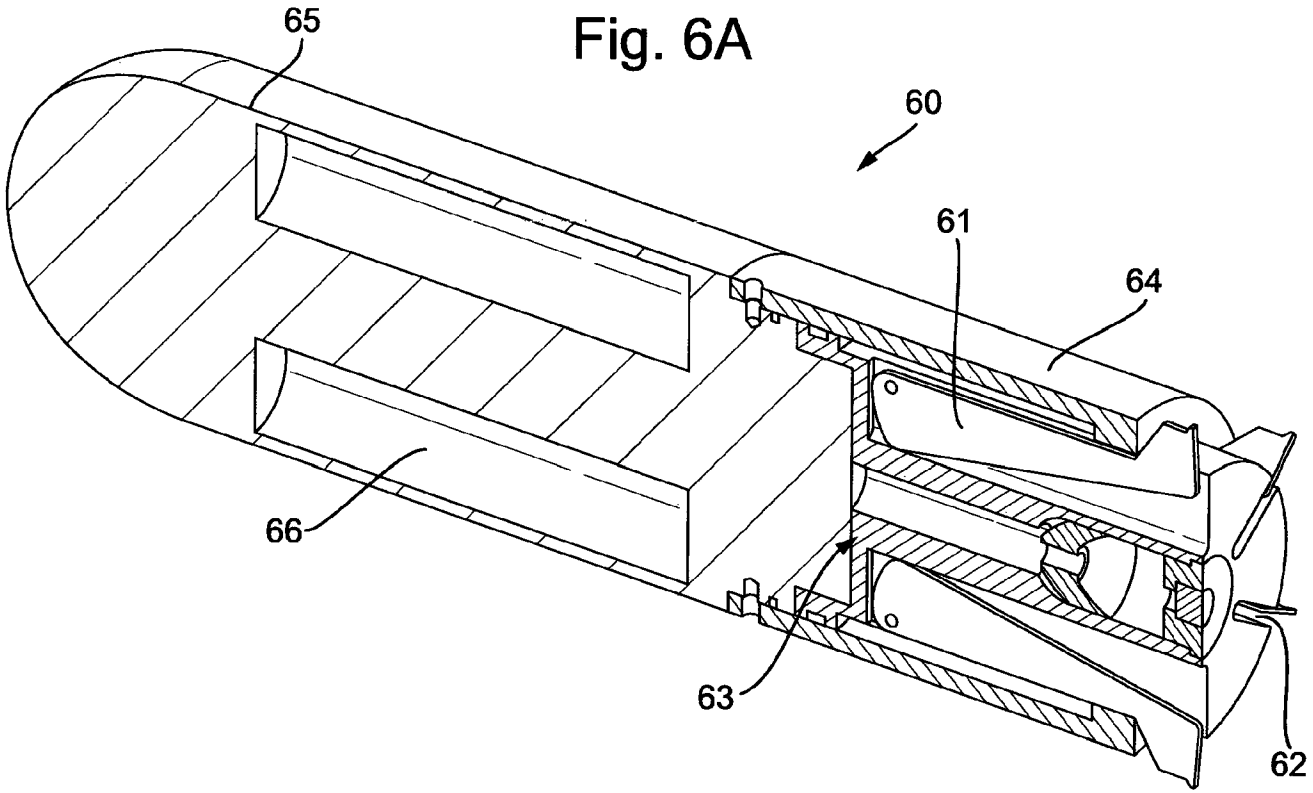
FIG. 6A illustrates in perspective cutaway view an embodiment of a captive piston projectile having stabilisation fins in the stowed configuration.
Figure 6B:
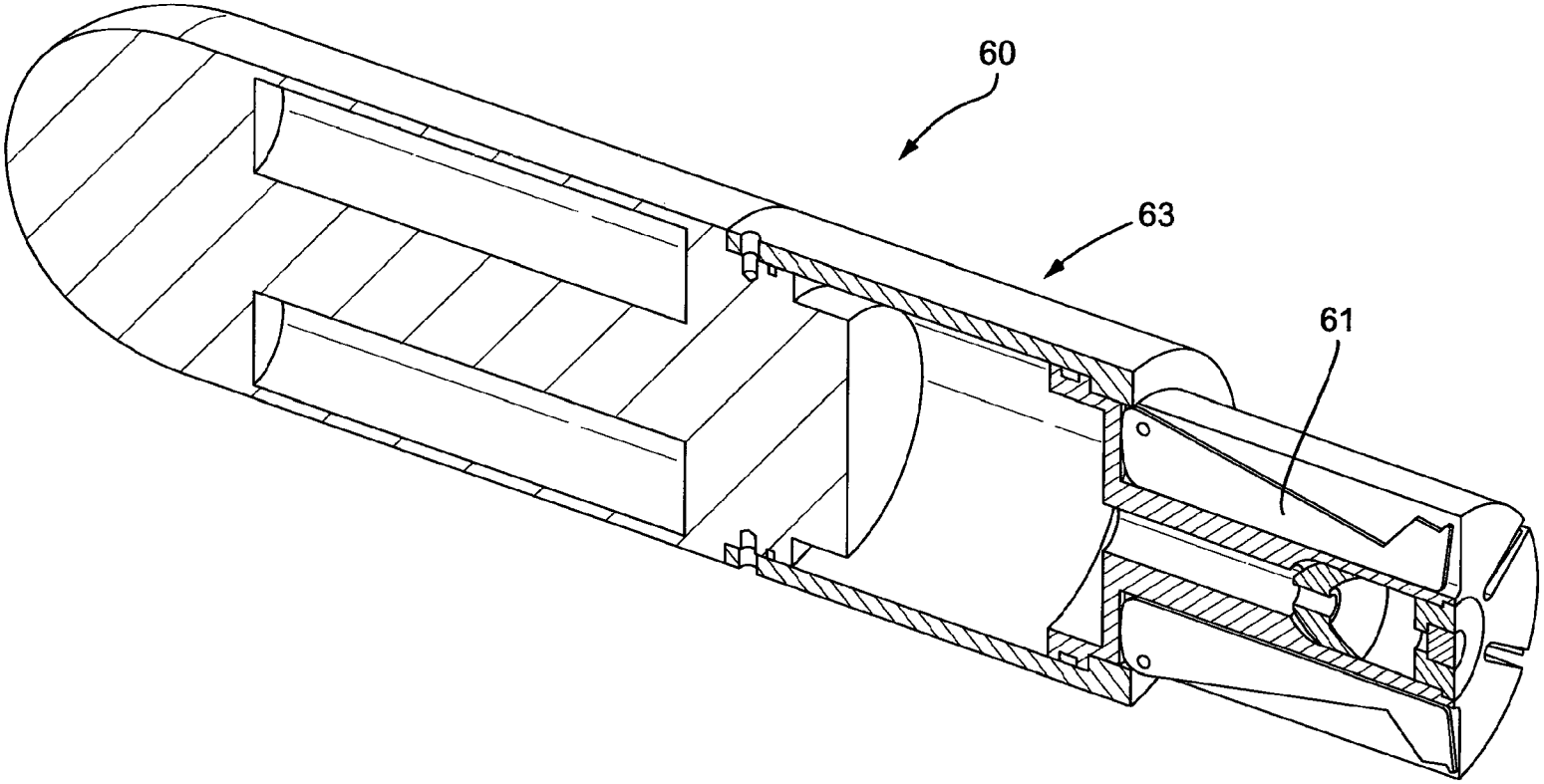
FIG. 6B illustrates in perspective cutaway view the embodiment of FIG. 6A with tubular piston member in the extended configuration.
Figure 6C:
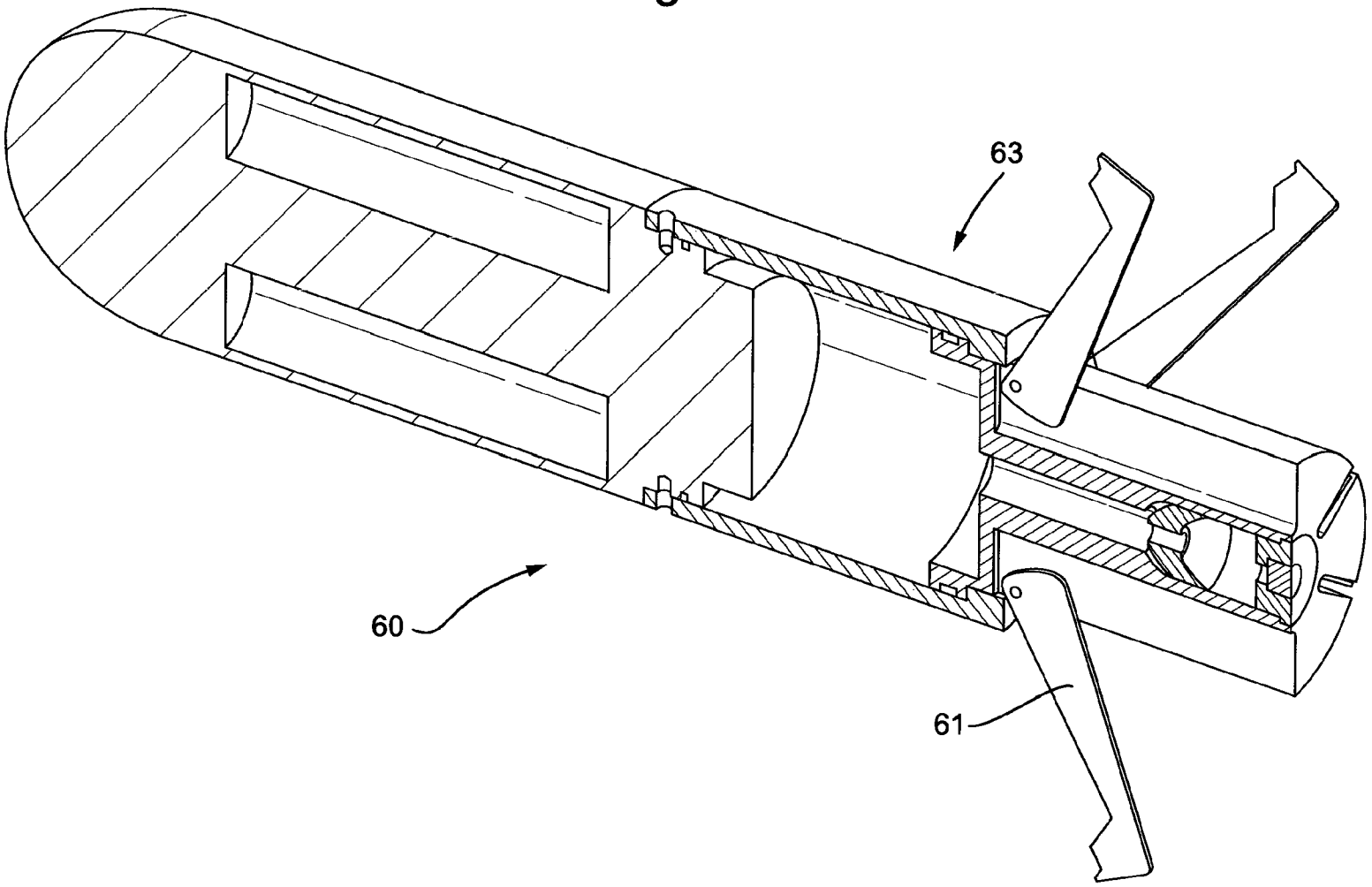
FIG. 6C illustrates in perspective cutaway view the embodiment of FIG. 6B with stabilisation fins deployed.

FIGS. 6A, 6B and 6C illustrate an embodiment of a captive piston projectile 60 comprising stabilisation fins 61. FIG. 6A shows stabilisation fins 61 stowed within recesses 62 of a tubular piston member 63. The tubular piston member 63 is held within a sleeve 64 and is in the stowed position. The stabilisation fins 61 are biased outwards of the piston member 63 by springs (not visible) but cannot leave recesses 62 owing to them abutting cartridge 64. Also shown in payload housing 65 are cut outs 66 indicating locations for projectile payloads or sub-munitions. FIG. 6B shows piston member 63 in the extended configuration but with stabilisation fins 61 still stowed. FIG. 6C shows stabilisation fins 61 deployed as would occur post launch when the piston member 63 is in the extended configuration and the projectile 60 has exited its weapon barrel.

Whilst embodiments of the invention have been described with specific features, other embodiments are envisaged that comprise one or more features from a number of the embodiments shown. For instance stabilisation fins may be used by a number of embodiments of the captive piston projectiles. The projectiles may be formed from metal or hardened plastic, and may comprise fabric (for instance for bellows). The overall shape of the projectile shown in the embodiments is not intended to be limiting, although an ogive or rounded nose to the payload housing may be advantageous for aerodynamics. The projectile may be manufactured in a variety of sizes, but is well suited as a 40 mm round. Propellant gases generated during launch of the captive piston projectile are preferably fully contained, or at least contained until after launch (when the projectile has left the gun barrel). This may allow lighter weight gun barrels to be used with the projectile, because there are no pressurised gases from propellant to be contained by the barrel. The piston stroke lengths are for example only and may be tailored to specific applications, however maximising the stroke length provides for improved projectile launch velocities. The projectile cartridges shown in the figures may be 0.38" or other custom size. Alternatively the propellant may be fully incorporated within the tubular piston member. The overall projectile mass is preferably less than 250 g, with the piston member mass being minimised to mitigate audible noise when the piston member impacts the projectile housing at the end of the piston stroke. Non circular cross section piston members may be used, provided that embodiments using such members seek to maximum the cross sectional area of the piston member to increase generated thrust. Whilst in some embodiments a projectile casing is provided this is not intended to be limiting, and all embodiments of the captive piston projectile may be operable without a casing (for instance detents may be used to retain the projectile in position inside a gun barrel pre-launch).

The invention claimed is:

1. A captive piston projectile for launching from a gun barrel, comprising a payload housing, a piston assembly, and means for actuation for urging the piston assembly from a stowed configuration to an extended configuration, such that in use the piston assembly urges against a breech of the gun barrel to thrust the captive piston projectile from the gun barrel, wherein the piston assembly comprises a tubular piston member with a first end attached around a periphery of the payload housing, such that when the piston assembly is in the extended configuration, a cross-sectional area of the first end approximates that of the payload housing, wherein the piston assembly is attached to the payload housing in both the stowed and extended configurations.

2. The captive piston projectile of claim 1 wherein the tubular piston member is collapsible such that in the stowed configuration the tubular piston member is collapsed against the payload housing.

3. The captive piston projectile of claim 2 wherein the tubular piston member comprises a bellows portion.

4. The captive piston projectile of claim 3 wherein in the stowed configuration the bellows portion is folded perpendicular to an axis of the captive piston projectile.

5. The captive piston projectile of claim 2 wherein the tubular piston member comprises a plurality of telescoping sections.

6. The captive piston projectile of claim 1 wherein the tubular piston member is arranged to slide with the payload housing, such that in the stowed configuration the payload housing is at least partially received into the tubular piston member.

7. The captive piston projectile of claim 6 wherein the payload housing comprises a circumferential groove into which the tubular piston member is arranged to slide.

8. The captive piston projectile of claim 7 wherein the circumferential groove comprises an end stop, the tubular piston member comprising a protrusion that abuts the end stop when in the extended configuration, such that the tubular piston member is retained within the circumferential groove.

9. The captive piston projectile of claim 6 wherein the tubular piston member is internally tapered.

10. The captive piston projectile of claim 6 further comprising stabilisation fins retractably attached to the tubular piston member.

11. The captive piston projectile of claim 10 wherein the stabilisation fins are recessed into respective longitudinal slots in the tubular piston member when the tubular piston member is in the stowed configuration.

12. The captive piston projectile of claim 10 wherein the stabilisation fins are biased outwards of the tubular piston member.

13. The captive piston projectile of claim 12 wherein the stabilisation fins are configured to act as detents for holding the captive piston projectile at a predetermined position inside a gun barrel.

14. The captive piston projectile of claim 6 further comprising a means for venting gases compressed by action of the tubular piston member sliding with the payload housing.

15. The captive piston projectile of claim 14 wherein the means for venting gases comprises vent grooves defined between the tubular piston member and the payload housing.

16. The captive piston projectile of claim 15 wherein the vent grooves are arranged to extend partway along a length of either the tubular piston member or the payload housing, such that in the extended configuration, gases compressed by action of the tubular piston member sliding with the payload housing are trapped to provide an air cushion.

17. The captive piston projectile of claim 1 wherein the means for actuation comprises a propellant cartridge in fluid connection with the tubular piston member, such that in use propellant gases can flow into the tubular piston member to urge the piston assembly into the extended configuration.

18. The captive piston projectile of claim 17 further comprising vent holes in the tubular piston member.

19. The captive piston projectile of claim 17 wherein the tubular piston member is sealed to the payload housing, such that propellant gases are retained between the tubular piston member and payload housing.

20. An ammunition round comprising a projectile casing and the captive piston projectile of claim 1.

21. A method of manufacturing a captive piston projectile, the method comprising:

a) providing a payload housing that comprises a piston assembly, the piston assembly comprising a tubular piston member;

b) attaching a first end of the tubular piston member around a periphery of the payload housing, the tubular piston member being adjustable between a stowed configuration and an extended configuration; and c) arranging an actuation means to urge the tubular piston member from the stowed configuration to the extended configuration when the captive piston projectile is in-use, wherein the piston assembly is attached to the payload housing in both the stowed and extended configurations.

22. The method of claim 21 wherein attaching a tubular piston member comprises configuring the tubular piston member to slide with the payload housing between the stowed configuration and the extended configuration.

23. The method of claim 22 wherein configuring the tubular piston member to slide comprises locating the tubular piston member inside a circumferential groove of the payload housing.

* * * * *